US005505131A

United States Patent [19]

Hachiya et al.

[11] Patent Number: 5,505,131

[45] Date of Patent: Apr. 9, 1996

[54] INK FOUNTAIN APPARATUS

[75] Inventors: Tadashi Hachiya, Yokohama; Yuji Kohara, Kodaira, both of Japan

[73] Assignee: Tokyo Kikai Seisakusho, Ltd., Tokyo, Japan

[21] Appl. No.: 429,140

[22] Filed: Apr. 26, 1995

[30] Foreign Application Priority Data

Oct. 3, 1994 [JP] Japan ..... 6-260915

[51] Int. Cl.[6] ..... B41F 31/04; B41F 31/06

[52] U.S. Cl. ..... 101/365

[58] Field of Search ..... 101/365, 350, 101/351, 352, 148, 157, 169; 118/261; 15/256.51

[56] References Cited

U.S. PATENT DOCUMENTS

| | | | |
|---|---|---|---|
| 3,730,090 | 5/1973 | Lambert | 101/365 |
| 4,803,923 | 2/1989 | Kenichi | 101/365 |
| 5,150,649 | 9/1992 | Kumaki et al. | 101/365 |
| 5,443,004 | 8/1995 | Kohara | 101/365 |

FOREIGN PATENT DOCUMENTS

| | | |
|---|---|---|
| 2-84339 | 3/1990 | Japan . |
| 4-15493 | 4/1992 | Japan . |
| 4-25329 | 6/1992 | Japan . |

*Primary Examiner*—J. Reed Fisher
*Attorney, Agent, or Firm*—Armstrong, Westerman, Hattori, McLeland & Naughton

[57] ABSTRACT

An ink fountain apparatus includes a plurality of ink blade segments which are arranged in a row extending in the axial direction of a ink fountain roller to form an adjustable ink supplying port between the ink blade segments and the peripheral surface of the ink fountain roller, and an adjusting mechanism provided for each of the ink blade segments to adjust the degree of opening of the ink supplying port. The adjusting mechanism includes a spring which forces the ink blade segment to retract away from the ink fountain roller, a press rod which contacts the rear end of the blade segment at its forward end and is provided with a cam follower facing toward the direction of retracting movement of the blade segment, and an end cam member which is rotatable about a rotational axis parallel to the direction of movement of the blade segment and has a cam surface which is in contact with the cam follower. The drive/transmission means mechanically coupled with the end cam member has a rotational axis parallel to the rotational axis of the end cam member. With this structure, the total size of the ink fountain apparatus and space needed for installing the ink fountain apparatus can be reduced.

8 Claims, 2 Drawing Sheets

INK FOUNTAIN APPARATUS

BACKGROUND OF THE INVENTION

1. Field of the Invention

The present invention relates to an ink fountain apparatus for a printing press, and more particularly to an ink fountain apparatus provided a mechanism for adjusting the degree of opening of of supplying port in which an end cam is utilized to move an ink supply adjusting member toward and away from an ink fountain roller for adjustment.

2. Description of Related Art

In an ink fountain for an ink supply apparatus for a printing press, ink is stored in an elongated space having a V-shaped cross section which is formed by the peripheral surface of an ink fountain roller, an ink supply adjusting member having a forward edge located proximity to the peripheral surface of the ink fountain roller, and a pair of side plates disposed at both lateral ends of the ink supply adjusting member. When the ink fountain roller is rotated, the ink stored in the elongated space is withdrawn through a gap between the peripheral surface of the ink fountain roller and the forward edge of the ink supply adjusting member.

To control the supply of ink, the degree of opening of the ink supplying port, i.e., the gap between the peripheral surface of the ink fountain roller and the forward edge of the ink supply adjusting member is adjusted by advancing and retracting the ink supply adjusting member.

Japanese Utility-Model Publication (kokoku) 4-15493 discloses an example of such a conventional ink fountain apparatus with an adjustable ink supply outlet.

In the ink fountain apparatus disclosed in that publication, an ink supply adjusting member is divided into a plurality of segmented members, and the segmented members are arranged in a row extending parallel to the axis of the ink fountain roller. Each ink supply adjusting segmented member is individually linearly displaced by interaction of a rotary plate cam and a compression spring. The rotational axis of the rotary plate cam is perpendicular to the direction of linear displacement of the ink supply adjusting segmented member. Also, the rotational axis of the drive/transmission mechanism for rotating the plate cam is perpendicular to the direction of linear movement of the ink supply adjusting segmented member.

In the above-described conventional ink fountain apparatus, the rotational axis of the rotary plate cam, which serves as a means for linearly displacing the ink supply adjusting segmented member, and the rotational axis of the drive/transmission mechanism are both perpendicular to the direction of linear movement of the ink supply adjusting segmented member. Also, the rotary plate cam and the drive/transmission mechanism are provided at the rear side of each ink supply adjusting segmented member.

Accordingly, the rotary plate cam, serving as a means for linearly displacing each ink supply adjusting segment, and the drive/transmission mechanism project from the rear end of the ink fountain, resulting in an increase in the total size of the ink fountain apparatus. This makes it difficult to reduce the size of the apparatus and the required installation space.

SUMMARY OF THE INVENTION

An object of the present invention is to solve the drawbacks of conventional ink fountain apparatus and to provide a compact ink fountain apparatus with ink supply adjusting segmented members.

Briefly, an ink fountain apparatus according to the present invention includes a ink fountain, a plurality of ink supply adjusting segmented members, and drive means. The ink fountain forms a space for storing ink in cooperation with a peripheral surface of an ink fountain roller. A forward edge of a bottom surface of the ink fountain faces the peripheral surface of the ink fountain roller with a gap therebetween which serves as an ink supplying port. The plurality of ink supply adjusting segmented members are disposed in a row extending in the axial direction of the ink fountain roller and are adapted to advance toward and retract from the ink fountain roller to adjust the degree of opening an ink supplying port. The drive means individually advances and retracts the ink supply adjusting segmented members. The drive means is composed of forcing means, a pressing member, an end cam member, and drive/transmission means. The forcing means forces the ink supply adjusting segmented member to retract away from the ink fountain roller. The pressing member contacts the rear end of the ink supply adjusting segmented member at its forward end and is provided with a cam follower which faces toward the direction of retracting movement of the ink supply adjusting segmented member. The end cam member is rotatable about a rotational axis parallel to the direction of movement of the ink supply adjusting segmented member and has a cam surface which is in contact with the cam follower. The drive/transmission means has a rotational axis parallel to the rotational axis of the end cam member, and is mechanically coupled with the end cam member for rotating the end cam member.

In a preferred embodiment, the drive means is provided with means for restricting the rotation of the end cam member. The restricting means is composed of a first stopper provided on the end cam member and a second stopper located on a path of movement of the first stopper to be engageable with the first stopper.

In the preferred embodiment, an annular cam surface is formed on the end cam member such that the cam surface is projected in the direction of the rotational axis of the end cam member and its highest and lowest regions are adjacent to each other. Also, the pressing member contacts the ink supply adjusting segmented member via a hemispherical surface.

In the above-described ink fountain apparatus, ink stored in the ink fountain adheres to the peripheral surface of the ink fountain roller in the space formed in the ink fountain. When the ink fountain roller is rotated, the ink is drawn from the space at a rate corresponding to the degree of opening of ink supplying port which is restricted by the forward edges of the ink supply adjusting segmented members, i.e., at a rate corresponding to the gap between the forward edges of the ink supply adjusting segmented members and the peripheral surface of the ink fountain roller. The ink drawn from the space adheres to the peripheral surface of the ink fountain roller so that a film of ink is formed thereon.

When it is necessary to adjust the supply of ink, i.e., to adjust the ink supply outlet formed between the forward edge of the bottom surface of the ink fountain and the peripheral surface of the ink fountain roller, the drive/transmission means mechanically coupled with the end cam member is operated. As a result, the end cam member, i.e., its cam surface is rotated.

At this time, the forcing means, which forces the ink supply adjusting segmented member to retract, presses the cam follower against the cam surface via the pressing member. Accordingly, the cam follower and the pressing member are moved back and forth in accordance with the shape of the cam surface of the end cam member. The back and forth movement of the pressing member produces a back and forth movement of the ink supply adjusting segmented member which is contacted by the hemispherical surface of the pressing member. As a result, the ink supply adjusting segmented member is advanced and retracted from the peripheral surface of the ink fountain roller along the bottom surface of the ink fountain.

As described above, the degree of opening of ink supplying port formed between the edge of the bottom surface of the ink fountain and the peripheral surface of the ink fountain roller is adjusted by the forward edge of the ink supply adjusting segmented member.

The cam surface is formed such that rotation of the end cam member in one direction causes the ink supply adjusting segmented member to advance, thereby decreasing the size of ink supply outlet, and rotation of the end cam member in the opposite direction causes the ink supply adjusting segmented member to retract, thereby increasing degree of opening of ink supplying port.

When the end cam member is rotated by the drive/transmission means in one direction and the first stopper contacts one side of the second stopper, the rotation of the end cam member is prevented, and the drive/transmission means is then stopped. In this state, the end cam member reaches one end of its rotation, and the cam follower contacts the highest region of the cam surface, so the forward edge of the ink supply adjusting segmented member minimizes the degree of opening of ink supplying port. For example, the forward edge of the ink supply adjusting segmented member contacts the peripheral surface of the ink fountain roller to reduce the degree of opening of ink supplying port to zero.

When the end cam member is rotated by the drive/transmission means by approximately one revolution in the opposite direction and the first stopper contacts the other side of the second stopper, the rotation of the end cam member is prevented, and the drive/transmission means is then stopped. In this state, the end cam member reaches the other end of its rotation, and the cam follower contacts the lowest region of the cam surface, so the forward edge of the ink supply adjusting segmented member maximizes the degree of opening of supplying port. For example, the forward edge of the ink supply adjusting segmented member is retracted behind the edge of the bottom surface of the ink fountain to fully open the ink supplying port.

By positioning the end cam member between the limits of its rotation, the degree of opening of supplying port can be adjusted between the fully open state and fully closed state.

The above and other objects, features and advantages of the present invention will become apparent from reading of the following description which has been made in connection with the accompanying drawings.

BRIEF DESCRIPTION OF THE DRAWINGS

The present invention is illustrated by the following drawings in which.

DETAILED DESCRIPTION OF PREFERRED EMBODIMENTS

An embodiment of an ink fountain apparatus according to the present invention will now be described with reference to the accompanying drawings.

Figure 1:
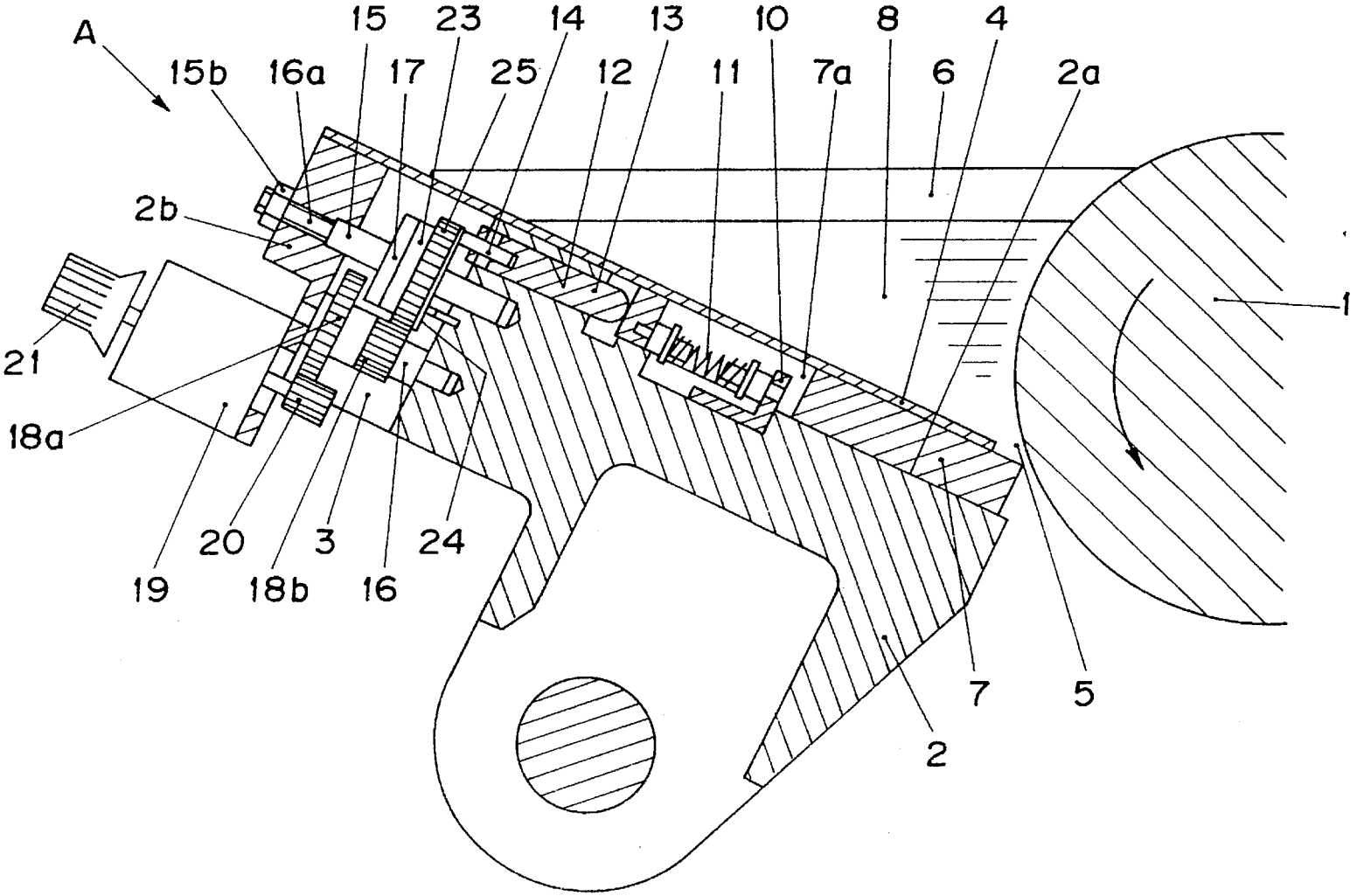
FIG. 1 is a partial sectional view showing an embodiment of an ink fountain apparatus according to the present invention.
Figure 2:
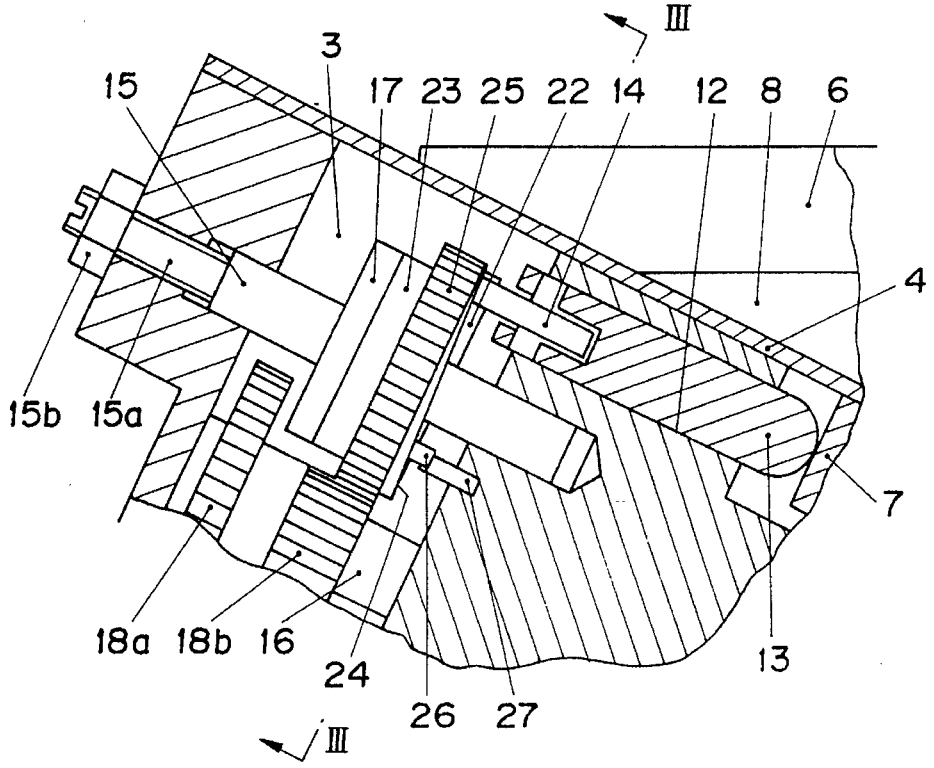
FIG. 2 is a sectional view showing the ink supplying port adjusting mechanism of the ink fountain apparatus according to the embodiment.
Figure 3:
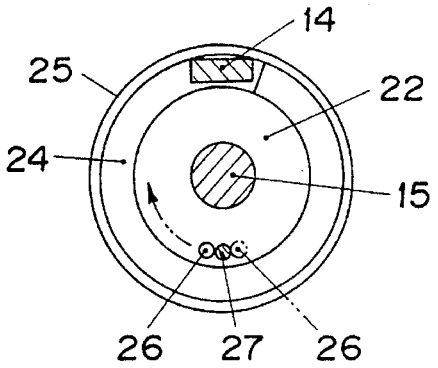
FIG. 3 is a sectional view taken along line III—III in FIG. 2.
Figure 4:
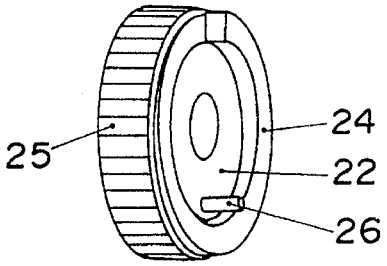
FIG. 4 is a perspective view showing an end cam member used in the ink supplying port adjusting mechanism shown in FIG. 2.

The ink fountain apparatus shown in FIG. 1 is provided with a base 2 which faces an ink fountain roller 1 rotated by an unillustrated drive mechanism in the direction indicated by the arrow (in the counterclockwise direction). The front half of the base 2 has an upper surface which is stepped downward from the upper surface of the rear half of the base 2, thereby providing a sloping surface 2*a* which extends downward toward the ink fountain roller 1. A through space 3 is formed vertically through the rear end of the base 2 for receiving an adjusting mechanism A, which will be described later.

A bottom plate 4 attached to the upper surface of the rear half of the base 2 covers the space 3 and extends forward in parallel with the sloping surface 2*a* with a gap corresponding to the step between the upper surfaces of the front and rear halves of the base 2. The lower edge of the inclined bottom plate 4 faces the peripheral surface of the ink fountain roller 1 and is spaced therefrom by a very small gap, which serves as an ink supplying port 5. At both lateral ends of the bottom plate 4, a pair of side plates 6 are vertically provided. The side plates 6 have arcuate forward edges which contact the peripheral surface of the ink fountain roller 1.

A plurality of ink blade segments 7 are inserted in the space between the sloping surface 2*a* and the bottom plate 4, and are arranged in a row extending parallel to the axis of the ink fountain roller 1 (in the direction perpendicular to the page in FIG. 1). The ink blade segments 7 are slidably guided to advance toward and retract away from the ink fountain roller 1, and their forward edges project beyond the lower edge of the bottom plate 4.

The bottom plate 4, the projected forward end portions of the ink blade segments 7, the side plates 6, and the peripheral surface of the ink fountain roller 1 define an elongated space 8 having a V-shaped cross section in which ink is stored.

The position of each ink blade segment 7 is adjusted by the adjusting mechanism A which is provided for each ink blade segment 7 so that the forward edge of the ink blade segment 7 approaches and separates from the peripheral surface of the ink fountain roller 1. As a result, the degree of opening of supplying port 5 between the lower edge of the bottom plate 4 and the peripheral surface of the ink fountain roller 1 is adjusted. In other words, the amount of ink withdrawn is restricted by the gap between the forward edge of the upper surface of the ink blade segments 7 and the peripheral surface of the ink fountain roller 1.

Next, the adjusting mechanism A provided for each of the ink blade segments 7 will be described.

As shown in FIG. 1, each ink blade segment 7 has a space 7*a* formed in the intermediate portion thereof, and a forcing mechanism is provided in the space 7*a* to force the ink blade segment 7 to move backward. In detail, a bracket 10 is vertically attached to the sloping surface 2*a* of the base 2 at a location corresponding to the forward side of the inner wall of the space 7*a*, and a compression coil spring 11 is assembled between a pair of engagement members each of which has a projection and which are attached to the bracket 10 and the rear side of the inner wall of the space 7*a*, respectively. The spring force of the compression coil spring 11 urges the ink blade segment 7 to move backward.

A plurality of guide holes 12 are formed in the rear half of the base 2 at locations corresponding to the ink blade segments 7. Each guide hole 12 extends in a direction parallel to the direction of movement of the ink blade segments 7 and penetrates the front and back walls of the space 3. Press rods 13 are slidably guided by the guide holes 12 so as to penetrate the guide holes 12. The press rods 13 have hemispherical forward end surfaces which contact the rear ends of the ink blade segments 7. Also, the press rods 13 are provided, at their rear ends projecting into the space 3, with follower rollers 14 each of which is supported for rotation about an axis perpendicular to the press rods 13 and contacts a cam surface of an end cam member which will be described later.

In the space 3, a shaft 15 and an intermediate gear shaft 16 are arranged underneath the press rod 13. The shaft 15 is supported for axial and rotational movements, and is provided at its intermediate portion with a flange 17. A screw portion 15*a* at the rear of the shaft 15 is screw-engaged with the rear wall 2*b* of the base 2 and is projected backward from the rear wall 2*b*. A lock nut 15*b* is screwed onto the projected end of the screw portion 15*a* to lock the shaft 15. First and second intermediate gears 18*a* and 18*b* are supported by the intermediate gear shaft 16 for rotation therewith.

The motor shaft of a motor 19 mounted to the back of the rear wall 2*b* of the base 2 extends parallel to the press rod 13 and projects into the space 3. A drive gear 20 is attached to the projected end of the motor shaft and is meshed with the first intermediate gear 18*a*. Also, an operating knob 21 is attached to the outer end of the motor shaft.

The end cam member 22 is assembled on the shaft 16 on the front side of the flange 17, i.e., between the flange 17 and the projecting rear end of the press rod 13. Also, a thrust bearing 23 is disposed between the flange 17 and the end cam member 22.

A cam surface 24 is formed on the front surface of the end cam member 22 which faces the press rod 13, and the follower roller 14 of the press rod 13, which is urged by the compression coil spring 11 to move backward, contacts the cam surface 24. The end cam member 22 is provided at its periphery with a ring gear 25 which is meshed with the second intermediate gear 18*b*. The cam surface 24 has an annular shape so that the follower roller 14 always contacts the cam surface 24 regardless of the rotational position of the end cam member 22 and so that its highest and lowest regions are adjacent to each other.

A revolving stopper pin 26 is embedded in the front surface of the end cam member 22 and is axially projected therefrom, while a stationary stopper pin 27 parallel to the revolving stopper pin 26 is embedded in the front wall of the space 3.

The revolving stopper pin 26 may be embedded in the rear surface of the end cam member 22 to axially project therefrom. Alternatively, the revolving stopper pin 26 may be embedded in the periphery of a boss which is projected backward from the rear end surface of the end cam member 22 and has a diameter smaller than that of the ring gear 25. In this case, the revolving stopper pin 26 radially projects from the peripheral surface of the boss and has a height such that it does not interfere with the second intermediate gear 18*b*. In either of these cases, the stationary stopper pin 27 is embedded in the inner surface of the rear wall 2*b*.

Both the revolving stopper pin 26 and the stationary stopper pin 27 project far enough to contact each other. Also, the distance between the stationary stopper pin 26 and the rotational axis of the end cam member 22 is equal to the radius of the revolving movement of the revolving stopper pin 26. Accordingly, the rotation of the end cam member 22 is restricted within a range (approximately one revolution) between one end of its rotation at which the revolving stopper pin 26 contacts one side of the stationary stopper pin 27 and the other end of its rotation at which the revolving stopper pin 26 contacts the other side of the stationary stopper pin 27.

Moreover, the positional relationship between the revolving stopper pin 26 and the stationary stopper pin 27 is set such that the cam follower 14 contacts the highest region of the cam surface 24 when the end cam member 22 is located at one end of its rotation, and such that the cam follower 14 contacts the lowest region of the cam surface 24 when the end cam member 22 is located at the other end of its rotation.

The operation of the above-described ink fountain apparatus is as follows.

Ink stored in the elongated space 8 adheres to the peripheral surface of the ink fountain roller 1. When the ink fountain roller 1 is rotated in the direction indicated by the arrow in FIG. 1 (in the counterclockwise direction), the ink is drawn from the space at a rate corresponding to the degree of opening of ink supplying port 5 which is restricted by the forward edges of the upper surfaces of the ink blade segments 7, i.e., at a rate corresponding to the gap between the forward edges of the ink blade segments 7 and the peripheral surface of the ink fountain roller 1. The ink drawn from the space adheres to the peripheral surface of the ink fountain roller 1 so that a film of ink is formed thereon.

When it is necessary to adjust the supply of ink, i.e., to adjust the ink supplying port 5 formed between the lower edge of the inclined bottom plate 4 and the peripheral surface of the ink fountain roller 1, the motor 19 is controlled by an unillustrated drive controller to rotate in its forward or reverse direction. As a result, the end cam member 22, i.e., the cam surface 24 is rotated via the drive gear 20, the first intermediate gear 18*a*, the second intermediate gear 18*b*, and the ring gear 25.

At this time, the compression coil spring 11, which forces the ink blade segment 7 to retract, presses the follower roller 14 against the cam surface 24 via the press rod 13. Accordingly, the follower roller 14, i.e., the press rod 13 is moved back and forth in accordance with the shape of the cam surface 24. The force acting on of the rotating end cam member 22 is received by the flange 17 via the thrust bearing 23. The back and forth movement of the press rod 13 produces a back and forth movement of the ink blade segment 7 which is contacted by the hemispherical forward end surface of the press rod 13. As a result, the ink blade segment 7 is advanced and retracted from the peripheral surface of the ink fountain roller 1 in the space between the sloping surface 2*a* of the base 2 and the bottom plate 4.

As described above, the ink supplying port 5 formed between the lower edge of the inclined bottom plate 4 and the peripheral surface of the ink fountain roller 1 is adjusted by the forward edge of the upper surface of the ink blade segment 7.

The cam surface 24 is formed, for example, such that forward rotation of the motor 19 causes the ink blade segment 7 to advance, thereby decreasing the degree of opening of ink supplying port 5, and reverse rotation of the motor 19 causes the ink blade segment 7 to retract, thereby increasing the degree of opening of ink supplying port 5.

Since the degree of opening of ink supplying port 5 is adjusted by the plurality of ink blade segments 7, the drawing rate of the ink can be adjusted at each of regions arranged in a row extending parallel to the axis of the ink fountain roller 1.

When the end cam member 22 is rotated by a forward rotation of the motor 19 and the revolving stopper pin 26 contacts one side of the stationary stopper pin 27, the rotation of the end cam member 22 is prevented, and the motor 16 is then stopped. In this state, the end cam member 22 reaches one end of its rotation, and the follower roller 14 contacts the highest region of the cam surface 24, so the forward edge of the upper surface of the ink blade segment 7 minimizes the degree of opening of ink supplying port 5. For example, the forward edge of the ink blade segment 5 contacts the peripheral surface of the ink fountain roller 1 to reduce the degree of opening of ink supplying port 5 to zero.

On the other hand, when the end cam member 22 is rotated by a reverse rotation of the motor 19 by approximately one revolution and the revolving stepper pin 26 contacts the other side of the stationary stopper pin 27, the rotation of the end cam member 22 is prevented, and the motor 19 is then stopped. In this state, the end cam member 22 reaches the other end of its rotation, and the follower roller 14 contacts the lowest region of the cam surface 24, so the forward edge of the upper surface of the ink blade segment 7 maximizes the degree of opening of ink supplying port 5. For example, the forward edge of the upper surface of the ink blade segment 7 is retracted behind the lower edge of the inclined bottom plate 4 to fully open the ink supplying port 5.

By positioning the end cam member 22 between the limits of its rotation, the degree of opening of ink supplying port 5 can be adjusted between the fully open state and fully closed state.

Instead of using the motor 19 to rotate the end cam member 22, i.e., to advance and retract the ink blade segment 7, the operating knob 16 attached to the motor shaft may be manually rotated.

The most advanced position, i.e., the initial position of the ink blade segment 7 is adjusted as follows. First, the lock nut **15*b* is loosened, and the shaft 15 is rotated with a suitable tool so that the end cam member 22 is move backward to a proper position. Simultaneously, the press rod 13 is moved backward to a proper position by the spring force of the compression coil spring 11 together with the ink blade segment 7. Thereafter, the end cam member 22 is rotated by manually rotating the operating knob 16 of the motor shaft to obtain a state in which the follower roller 14 contacts the highest region of the cam surface 24**.

Since the operating knob 16 is provided at a location which allows an operator to easily perform visual checking and to easily operate the knob 16, the operability and work efficiency can be increased.

Thereafter, the shaft 15 is rotated with the tool to advance so that the press rod 13 is advanced with the follower roller 14 contacted by the highest region of the cam surface 24 until the ink blade segment 7 reaches a most forward position against the spring force of the compression coil spring 11.

To maintain this state, the lock nut **15*b* is tightened so that the axial positions of the shaft 15, the end cam member 22, the press rod 13, and the ink blade segment 7 are fixed. In this manner, the initial position of the ink blade segment 7 is set. The position of the ink blade segment 7** is thereafter adjusted in the above-described manner within a range extending backward from the initial position, i.e., the reference position.

In the ink fountain apparatus according to the present invention, an end cam member is utilized to linearly displace each ink supply adjusting segmented member, and the end cam member has a rotational axis parallel to the direction of the linear displacement of the ink supply adjusting segmented member. Accordingly, the drive/transmission mechanism mechanically coupled with the end cam member does not project backward from the ink fountain. This makes it possible to reduce the total size of the ink fountain apparatus and minimize the installation space.

While the present invention has been described above with respect to typical preferred embodiments thereof, it should of course be understood that it should not be limited to these embodiments, and various changes or modifications may be made without departing from the scope of the invention as defined by the appended claims.

What is claimed is:

1. An ink fountain apparatus including a ink fountain which forms a space for storing ink in cooperation with a peripheral surface of an ink fountain roller, a forward edge of a bottom surface of said ink fountain facing the peripheral surface of said ink fountain roller with a gap therebetween which serves as an ink supplying port, a plurality of ink supply adjusting segmented members which are disposed in a row extending in the axial direction of said ink fountain roller and are adapted to advance toward and retract from said ink fountain roller to adjust the degree of opening of the ink supplying port, and drive means which individually advances and retracts the ink supply adjusting segmented members, wherein said drive means comprises:

forcing means for forcing each said ink supply adjusting segmented member to retract from the ink fountain roller;

a pressing member adapted to contact a rear end of each said ink supply adjusting segmented member at its forward end and having a cam follower which faces toward the direction of retracting movement of each said ink supply adjusting segmented member;

an end cam member supported to be rotatable about a rotational axis parallel to the direction of movement of each said ink supply adjusting segmented member and having a cam surface which is in contact with said cam follower; and a drive/transmission means having a rotational axis parallel to the rotational axis of said end cam member and being mechanically coupled with said end cam member.

2. An ink fountain apparatus according to claim 1, wherein said drive means comprises means for restricting rotation of said end cam member, said restricting means comprising a first stopper provided on said end cam member and a second stopper located on a path of movement of said first stopper to be engageable with said first stopper.

3. An ink fountain apparatus according to claim 1, wherein said cam surface formed on said end cam member is annular and is projected in the direction of the rotational axis of said end cam member such that its highest and lowest regions are adjacent to each other.

4. An ink fountain apparatus according to claim 2, wherein said cam surface formed on said end cam member is annular and is projected in the direction of the rotational axis of said end cam member such that its highest and lowest regions are adjacent to each other.

5. An ink fountain apparatus according to claim 1, wherein said pressing member contacts each said ink supply adjusting segmented member via a hemispherical surface formed at a forward end of said pressing member.

6. An ink fountain apparatus according to claim 2, wherein said pressing member contacts each said ink supply adjusting segmented member via a hemispherical surface formed at a forward end of said pressing member.

7. An ink fountain apparatus according to claim 3, wherein said pressing member contacts each said ink supply adjusting segmented member via a hemispherical surface formed at a forward end of said pressing member.

8. An ink fountain apparatus according to claim 4, wherein said pressing member contacts each said ink supply adjusting segmented member via a hemispherical surface formed at a forward end of said pressing member.

* * * * *